United States Patent [19]

Buffenoir et al.

[11] Patent Number: 4,960,967

[45] Date of Patent: Oct. 2, 1990

[54] DEVICE FOR PROTECTING THE POLES OF INDUCTORS AND INDUCTOR EQUIPPED WITH SUCH DEVICE

[75] Inventors: Marc Buffenoir; René Pierret, both of Metz; Jean Hellegouarc'h, Le Perreux Sur Marne; Gérard Prost, Boulevard Jean Jaurés, all of France

[73] Assignee: Institut De Recherches De La Siderurgie Française, Maizieres-les-Metz, France

[21] Appl. No.: 343,239

[22] Filed: Apr. 29, 1989

[30] Foreign Application Priority Data

Apr. 26, 1988 [FR] France ..... 88 05940

[51] Int. Cl.[5] ..... H05B 6/42

[52] U.S. Cl. ..... 219/10.491; 219/10.75; 219/10.79; 336/61; 336/55; 165/103; 165/178; 335/300

[58] Field of Search ..... 219/10.491, 10.75, 10.79; 336/61, 55; 335/300; 165/178, 177, 185, 101, 102, 103

[56] References Cited

U.S. PATENT DOCUMENTS

| | | | |
|---|---|---|---|
| 2,819,431 | 1/1958 | Maxwell | 336/61 |
| 3,295,598 | 1/1967 | Metzger | 165/185 |
| 3,437,132 | 4/1969 | Venema | 165/177 |
| 3,713,060 | 1/1973 | Harlow | 336/61 |
| 3,763,342 | 10/1973 | Oppenheimer | 336/61 |
| 3,818,979 | 6/1974 | Hilgemann | 165/101 |
| 4,532,398 | 7/1985 | Henriksson | 219/10.491 |

*Primary Examiner*—Philip H. Leung

*Attorney, Agent, or Firm*—Pollock, VandeSande & Priddy

[57] ABSTRACT

The device for protecting the poles of an electromagnetic inductor comprises a heat exchanger formed by one or more co-planar metal tubes (6) designed to allow the circulation of a cooling fluid therein and of such an arrangement that there is at most one electrical junction between any two tubes or tube elements. The exchanger is fastened to a rigid electrically insulating support plate (5) coated with refractory concrete (10) and covers the entire polar surface as far as the cowls (3). The exchanger can be shaped in the form of a series of alternating hairpins or in the form of a spiral with one or more branches. The device serves especially for protecting the poles of inductors used for the induction heating of metal products.

17 Claims, 1 Drawing Sheet

DEVICE FOR PROTECTING THE POLES OF INDUCTORS AND INDUCTOR EQUIPPED WITH SUCH DEVICE

FIELD OF THE INVENTION

The present invention relates to a device for protecting the poles of inductors used especially for the induction heating or reheating of metal products.

BACKGROUND OF THE INVENTION

It is known to use electromagnetic inductors of the transmitting-field type for this purpose. Such inductors are described particularly in FR No. 2,583,249. In general terms, they comprise a C-shaped magnetic yoke, the ends of the C which form the two poles of the inductor carrying the induction coils being located on either side of the product to be heated.

To maintain high efficiency, the poles must be as near as possible to the product. This means that the poles and the induction coils which they carry are subjected to a high degree of thermal radiation from the hot product. Moreover, under industrial operating conditions, for example during the heating of the edges of slabs or rolled products, the inductors and especially their poles are subjected to chemical and mechanical attacks, for example considerable splashing, the deposition of scale and the risk of impact with the heated product.

A known device for protecting the poles consists of a plate made of porous refractory and is placed on the face of the pole confronting the product, this refractory being cooled by internal air circulation. These devices afford good thermal protection, but nevertheless have the disadvantage of easily oxidizing and becoming clogged and of being attacked by the scale coming from the heated product. This results in the need to replace this porous refractory somewhat frequently, thus making it necessary to shut down the installation, thereby incurring operating costs which are added to the high cost of the said refractory.

SUMMARY OF THE INVENTION

The object of the present invention is to ensure the reliable and durable protection of the poles of inductors subjected to both thermal and mechanical and chemical stresses, without causing a loss of heating efficiency.

Another object is to solve the various problems mentioned above.

With these aims in view, the subject of the present invention is a device for the especially thermal protection of the poles of an electromagnetic inductor.

According to the invention, this device comprises a heat exchanger formed by one or more substantially coplanar non-magnetic metal tubes designed to allow the circulation of a cooling fluid therein and so arranged that there is at most only one electrical junction between any two tubes or tube elements, so as to limit the electrical looping between tubes or tube portions whether or not they are adjacent.

The term "electrical junction" is here intended to refer to direct contact or low-resistance connections, excluding high-resistance connections occurring in materials which are not perfect insulators.

According to one embodiment of the invention, the exchanger is shaped in the form of a series of alternately reversed hairpins.

According to another embodiment the exchanger is shaped in the form of a spiral with one or more branches.

According to yet another embodiment, the exchanger is supported and fastened to a rigid electrically insulating plate and is coated with refractory concrete, the assembly as a whole forming a composite panel of small thickness and of dimensions sufficient to cover the polar face of each pole.

In fact, the device according to the invention makes it possible to reconcile two functions of divergent effects: on the one hand, the thermal protection of the pole as a result of forced cooling by means of a metal-tube exchanger and, on the other hand, the preservation of high heating efficiency in the inductor.

In fact, an assembly of metal tubes interposed between the pole and the product generally forms a screen which opposes the passage of the magnetic flux and in which high-intensity electrical currents can be generated, the effects of these being to oppose the passage of the flux and heat the circuit where they are generated.

The arrangement of the tubes according to the invention makes it possible to prevent these effects and ensure maximum "transparency" of the intense magnetic field generated by the inductor.

Another subject of the invention is an inductor equipped with the pole protection device, as described above, which will then be given advantageous dimensions and placed opposite each of the polar faces, the form of which it matches so as to cover these as well as the induction coils, the insulators and the cowls, in order to ensure good sealing of the assembly consisting of the pole and of its circuits.

BRIEF DESCRIPTION OF THE DRAWINGS

Other characteristics and advantages will emerge from a reading of the following illustrative description of a device according to the invention, with reference to the accompanying drawings in which.

DESCRIPTION OF PREFERRED EMBODIMENT

Figure 1:
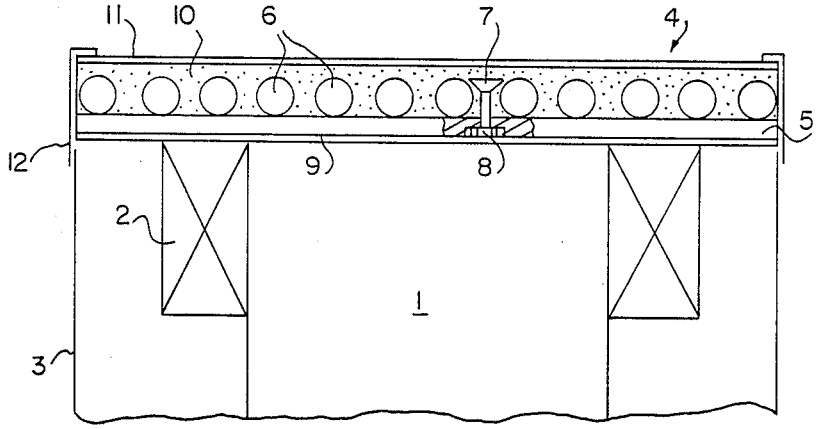
FIG. 1 is a schematic view of an inductor pole equipped with its protective device which is shown in section.

FIG. 1 shows a pole of an inductor of the C-shaped type with an articulated yoke, as described in FR No. 2,583,249 to which reference can be made for more details of the general construction of the inductor. It is merely recalled here that, in this type of inductor intended especially for heating the edges of blanks of generally flat metal products, a second pole similar to that shown in FIG. 1 is arranged opposite the latter, the two poles forming the ends of a C-shaped magnetic yoke connecting them. The effect of the intense magnetic field generated by the inductor is to heat the product passing between the two mutually confronting poles. The induced powers are of the order of several hundred KW, and this, in relation to the surface of the yoke, corresponds to powers which may exceed 5 $MW/m^2$.

The pole of FIG. 1 comprises an induction coil 2 surrounding the end of the magnetic yoke 1. A protective cowl 3 surrounds the entire polar end (yoke and coil), and a thermal screen can be interposed between the coil 2 and the cowl 3.

The composite plate 4 constituting the protective device according to the invention is formed from a support plate 5 made of a rigid electrically insulating non-metallic material, such as a material based on glass fiber, for example "sillirite 64120", of a thickness of a few millimeters.

Figure 2:
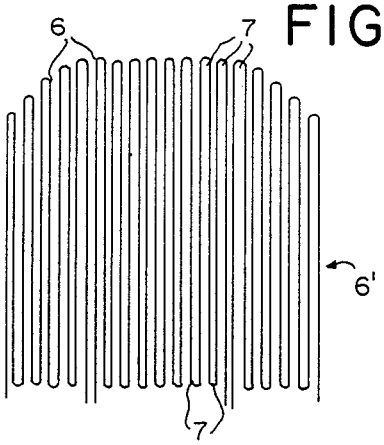
FIG. 2 is a diagram of the circuit of the exchanger in its "hairpin" configuration.

A stainless-steel tube exchanger 6 coated with epoxy resin is fastened to the support plate 5. This exchanger has a configuration in the form of alternate successive "hairpins", as shown in FIG. 2. The exchanger 6 is fastened to the support plate 5 by means of screws 7 placed in the cavity of each of the "pins" of the circuit, as shown schematically in FIG. 2. This arrangement is intended especially for preventing electrical looping between two adjacent pins, which would occur if conductive parts were in simultaneous contact with two pins, successive or not, at a location other than that indicated.

The nut 8 of the screw 7 is placed in a countersink made in the support plate 5, so as not to project above the surface of the latter. A sheet 9 of insulating material is glued under the plate 5, concealing the nuts 8 and thus guaranteeing electrical insulation between the fastening screws 7.

The tubes 6 of the exchanger are coated in a refractory concrete 10 (for example, concrete based on silicon carbide sold under the name of "morgan montex CIM02"). This concrete covers the tubes 6 completely and its low electrical conductivity allows possible looping currents between adjacent pins to be limited.

Advantageously, but not necessarily, this concrete is covered on one face with a plate 11 made of glass-ceramic material or any other similar material having high resistance to heat and above all to thermal shocks, together with good mechanical resistance. It is also possible to use, instead of this plate, a ceramic textile fabric or an insulating covering (of the type usually known as "coating") based on alumina or silica.

The composite plate 4 is fastened to the pole of the inductor by bolting either directly on the yoke or on accessory supports arranged between the coil and cowls.

Whatever the fastening means, these are insulated electrically from the tubes 6 of the exchanger.

The thickness of the plate 4 is approximately 15 mm, and its dimensions and form are determined so as to cover the entire pole as far as the cowl 3, a gusset 12 being arranged round the plate 4 in order to prevent the infiltration of water or the penetration of dust or other solid bodies inside the cowl 3.

FIG. 2 illustrates diagrammatically a preferred arrangement of the tubes of the exchanger. Here, this is produced in the form of three independent circuits, thus making it possible, for example, to adjust the intensity of the cooling, according to the zones covered, by regulating the flow of the cooling fluid, usually water. This "hairpin" arrangement makes it possible to cover the surface of the pole as effectively as possible, because it is easy to adapt the number and length of the pins to the shape of the surface to be covered.

Figure 3:
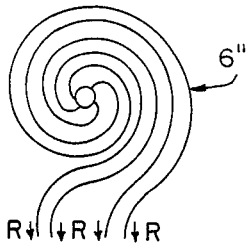
FIGS. 3 and 4 are two diagrams of the circuit of the exchanger in its spiral configuration.
Figure 5:
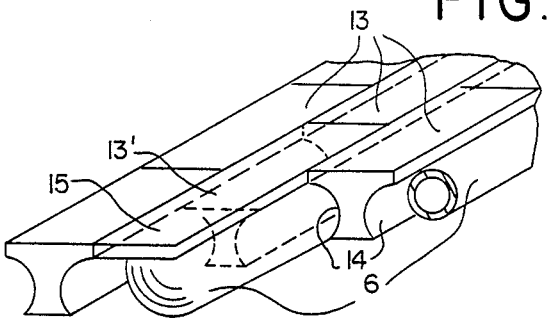
FIG. 5 is a partial detailed view of an alternative version using refractory blocks instead of an integral concrete coating.
Figure 4:
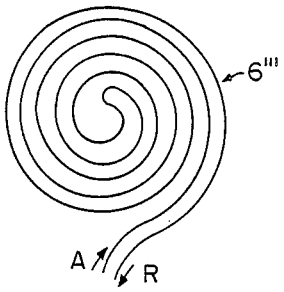

Alternatively, the exchanger can have a spiral configuration, as shown in FIGS. 3 and 4.

FIG. 4 shows schematically an arrangement in the form of an inverted double spiral with a single tube; the supply and return of the cooling fluid are represented by the arrows A and R.

The arrangement of FIG. 3 has four spirals fed by a central supply. In this case, feeding takes place via a pipe in the axis of the pole through the yoke 1.

A central supply can also be provided in the arrangements of FIGS. 2 and 4 and has the advantage of contributing to the cooling of the magnetic yoke.

An essential characteristic of these exchangers is that two tubes or tube elements are joined at most at one point, to prevent any electrical looping in the exchanger.

The tubes are preferably made of non-magnetic stainless steel and for the sake of simplicity are of circular cross-section. It is possible, especially to reduce the thickness of the protective composite plate 4, to use tubes of flattened cross-section or even, if appropriate, of virtually rectangular cross-section.

Tubes of reduced thickness will always be chosen in order to reduce the possible electrical currents generated by the magnetic field, by increasing the electrical resistance of the said tubes. Moreover, the tubes, instead of being coated with epoxy resin, can, as mentioned above, be covered with an insulating film or be coated with another insulating resin (for example, polyester).

Since the essential function of the protective device is to form a thermal screen protecting the pole and its accessories from the radiation of the heated product, the aim will be to bring the tubes as close to one another as possible. Moreover, more particularly when the device has a plate 11 made of glass-ceramic material, the use of a concrete of somewhat high thermal conductivity allows the heat received by its surface to diffuse into its mass and thereby makes it possible to ensure cooling of the said glass-ceramic plate which can thus be maintained at a temperature in the neighborhood of, for example, 700° C., whereas the heated product is at more than 1000° C.

Insofar as the mechanical characteristics of the concrete used allow, it is also possible to omit a support plate.

In another alternative version, particularly in the "hairpin" exchanger, instead of embedding the tubes 6 in the refractory concrete 10, the latter can be replaced by a plurality of blocks 13 of insulating material having similar characteristics (refractory concrete, ceramic quartz, etc.), so as to reconstruct the entire concrete coating 10.

These blocks have a width equal to the center distance between two adjacent tubes 6, and on their longitudinal sides they possess concavities 14 matching the cross-section of the tubes, so as to be insertable between these in order substantially to reconstruct the concrete coating 10. Several of these adjacent blocks will preferably be placed in the same space between tubes. This arrangement in the form of separate blocks allows differential expansions between different zones of the device, without the risks of cracking which exist where the integral concrete 10 is concerned. In order to cover the curved zones of the pins, the first block 13' of each row has an extension 15 of its plane upper part.

The invention is not limited to the device and its alternative versions described above purely by way of example. Particularly as regards the arrangement of the tubes in the form of "hairpins", it is possible to arrange, in the same zone, two or more tubes having this configuration, but arranged in parallel, each pin of one tube being interleaved in a pin formed by the other tube, this taking place alternately, and of course all the pins remaining coplanar.

This arrangement makes it possible to reduce the pressure losses in the tubes, especially because the hairpin curvature of the tube located on the outside at the point of curvature is lower than the curvature of the tube located on the inside at this point.

It is also possible to provide an additional tube surrounding the set of tubes arranged in a hairpin formation, in order to make the cooling more uniform in the zone near the ends of the pins and/or prevent heating of the angle pieces forming the gusset 12.

The invention also applies to inductors having a different shape, particularly a U-shaped.

We claim:

1. An electromagnetic indicator having poles with a polar face and a protective device for a polar face of each pole, said protective device comprising a heat exchanger comprising at least one non-magnetic metal tube, each tube being constituted by several tube elements joined end to end and arranged substantially in a same plane parallel with said polar face, and means for circulating a cooling fluid through said at least one tube, any two tube elements being electrically joined by at most one electrical junction.

2. The inductor claimed in claim 1, wherein said heat exchanger is in the form of a series of alternately reversed hairpins.

3. The inductor claimed in claim 1, wherein said heat exchanger is in the form a spiral with at least one branch.

4. The inductor claimed in claim 1, wherein said heat exchanger is embedded in electrically insulating refractory material.

5. The inductor claimed in claim 4, wherein said material is refractory concrete.

6. The inductor claimed in claim 1, wherein blocks of electrically insulating refractory material are inserted between adjacent tube elements, said blocks being shaped so as to conform to external surfaces of said tube elements and to cover partially said tube elements so that said blocks jointly cover substantially the entire exchanger.

7. The inductor claimed in claim 4 or 6, wherein said at least one tube and said refractory material jointly form a composite panel of small thickness and of dimensions sufficient to cover said polar face of said pole.

8. The inductor claimed in claim 7, comprising a plate of material resistant to heat and thermal shocks covering one face of said refractory material.

9. The inductor claimed in claim 7, wherein said plate is made of glass-ceramic material.

10. The inductor claimed in claim 1, comprising means for fastening said heat exchanger to a rigid electrically insulating support plate, said fastening means being electrically insulated from one another.

11. The inductor claimed in claim 1, wherein said at least one tube is made of non-magnetic stainless steel.

12. The inductor claimed in claim 1, wherein said heat exchanger has a central supply of said cooling fluid.

13. The inductor claimed in claim 12, comprising a C-shaped yoke.

14. The inductor claimed in claim 12, comprising a U-shaped yoke.

15. The inductor claimed in claim 13 or 14 comprising an axial passage in an end of said yoke for said central supply.

16. The inductor claimed in claim 1, wherein said protective device sealingly covers in the entire surface of said pole.

17. The inductor claimed in claim 1, comprising electrically insulated means for fastening said protective device to said pole.

* * * * *